United States Patent [19]

Chang

[11] 4,323,816

[45] Apr. 6, 1982

[54] SYSTEM FOR ENHANCING DEFLECTION IN KINESCOPES

[75] Inventor: Kern K. N. Chang, Princeton, N.J.

[73] Assignee: RCA Corporation, New York, N.Y.

[21] Appl. No.: 154,835

[22] Filed: May 30, 1980

[51] Int. Cl.[3] ..... H01J 29/72; H01J 29/80

[52] U.S. Cl. ..... 313/433; 313/429

[58] Field of Search ..... 313/429, 431, 433, 426, 313/421(U.S. only), 427, 413(U.S. only)

[56] References Cited

U.S. PATENT DOCUMENTS

| | | | |
|---|---|---|---|
| 2,879,443 | 3/1959 | Aiken | 313/422 |
| 3,240,972 | 3/1966 | Law | 313/429 |
| 3,496,406 | 2/1970 | Deschamps | 313/429 |
| 3,792,303 | 2/1974 | Albertin et al. | 313/429 X |

*Primary Examiner*—Robert Segal

*Attorney, Agent, or Firm*—Eugene M. Whitacre; Glenn H. Bruestle; Lester L. Hallacher

[57] ABSTRACT

In a kinescope a pair of curved plates cooperate with the conductive coating inside the tube funnel to form electrostatic lens. The lens is shaped by the curve of the plates to eliminate convergence of the electron beams as they enter the field of the lens to enhance the horizontal deflection of the kinescope. The internal focusing and defocusing actions of the quadrupole are suppressed within the quadrupole, but a vertical divergent field outside the quadrupole substantially enhances the vertical deflection.

4 Claims, 7 Drawing Figures

11
12
13
14
16
17
18
18a
19
21
22
23
24
26a
26b
27a
27b
28
29
V1
V2
X
Y
Z
N
S

SYSTEM FOR ENHANCING DEFLECTION IN KINESCOPES

BACKGROUND OF THE INVENTION

This invention relates generally to kinescopes and particularly to a deflection system for enhancing the horizontal and vertical deflection in such devices.

Kinescopes include an envelope having a neck portion attached to the narrow end of a funnel portion. A screen is hermetically attached to the wide end of the funnel and the envelope is evacuated. An electron gun is housed within the neck and emits electrons which travel as beams through the funnel to strike the screen. A phosphor coating on the screen luminesces in response to the electron impact to produce a visual output. Because the visual output is provided across the entire face of the screen, it is necessary to vertically and horizontally deflect the electron beam so that the entire screen is sequentially scanned. Typically, this deflection is accomplished by the use of a yoke which is arranged around the outside of the neck portion. The yoke contains horizontal and vertical deflection windings which are respectively energized with horizontal and vertical scanning voltages to effect the required scanning of the entire screen.

The relationship between the length of the tube, that is the distance between the electron gun and the screen, and the horizontal and vertical dimensions of the screen is primarily dependent upon the ability to deflect the electron beam away from the center line of the tube. Accordingly, a decrease in the length of the tube necessitates an increase in either the voltage, i.e., power, supplied to the coils of the deflection yoke, or the number of turns in the coils, of a combination of both of these parameters. An increase in the power of the yoke coils is objectionable because of the resulting continuing increase in the expense of operating the kinescope. An increase in the number of turns in the coils is objectionable because of the increase in size, weight and material costs which naturally result. Therefore, a need exists for a deflection enhancement system which reduces the power required to deflect the electron beam. Such a system could also be used to decrease the length of the tube without increasing either the deflection power or the number of turns in the deflection coils. The present invention is directed to that need.

SUMMARY OF THE INVENTION

A kinescope in which a yoke deflects the electron beam to horizontally and vertically scan a screen, includes a deflection system for enhancing the horizontal and vertical deflection. Horizontal deflection is enhanced by an electrostatic lens which includes curved plates arranged in parallel and equally spaced above and below the center line of the kinescope so that the space between the plates is parallel to the direction of the horizontal deflection. The plates cooperate with a conductive coating on the inside of the kinescope funnel to enhance the horizontal deflection. A quadrupole lens is oriented so that an internal defocusing action acts in the direction of vertical scanning. The internal defocusing action and an internal focusing action are both shunted out so that an electron beam is unaffected within the quadrupole. However, the electrostatic lens and the quadrupole cooperate to enhance both the horizontal and vertical deflection as the electron beam exits from the quadrupole.

DETAILED DESCRIPTION OF THE PREFERRED EMBODIMENT

Figures 1, 2, 3A:
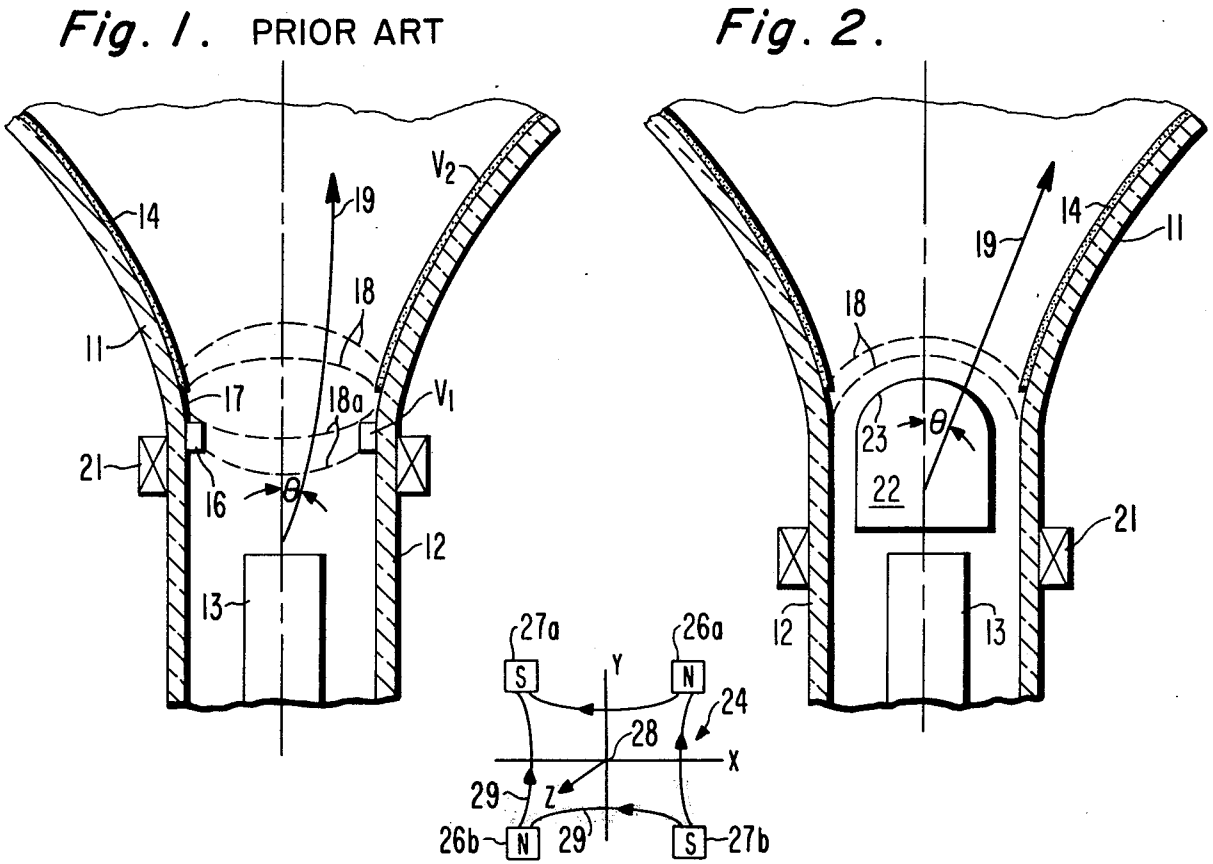
Fig. 1. PRIOR ART
Fig. 3a. PRIOR ART
FIG. 1 is a simplified diagram of a prior art electrostatic lens.
FIG. 2 is a simplified showing of an electrostatic lens utilized in the preferred embodiment.
FIG. 3*a* shows a prior art type of a quadrupole lens.

FIG. 1 is a partially broken away cross-section of a prior art kinescope employing post-deflection acceleration. The kinescope includes a funnel portion 11 and a neck portion 12 which are integrally coupled and both of which are circular in cross-section. An electron gun 13 is centered in the neck portion 12 and emits electrons toward a display screen, not shown, which is integral with the wide end of the funnel portion 11. The inside of the funnel portion 11 is coated with a conductive material 14 and a conductor 16 is arranged around the inside of the neck portion 12, leaving a space 17 between the conductors 14 and 16.

The electrode 16 is biased with a potential V1 and the electrode 14 is biased with a substantially higher potential V2. Electrons, therefore, are accelerated as they pass through the electrostatic lens giving them an increased energy so that the visual output is brighter. The voltages V1 and V2 create the equipotential lines 18 and 18*a* which bend electron beams crossing them in a direction toward the normal to the tangents of the fields at the point of crossing. An electron beam 19 from the electron gun 13 approaches the field lines 18*a* and angle $\theta$ with respect to the center line of the kinescope. However, because the electron beam is bent by the fields 18*a* the electron beam converges toward the center line of the kinescope. The field lines 18 bend the electron beam away from the center line but because the electrons are accelerating, the net effect is a bending toward the center line along the curved path 19. The lens formed by the electrodes 14 and 16, therefore, decreases the deflection of the electron beam.

A deflection yoke 21 is positioned around the electrode 16 and outside of the neck 12. The yoke 21 is wound with separate horizontal and vertical windings. For the orientation shown in FIG. 1 horizontal deflection occurs in the plane of the paper and vertical deflection occurs perpendicular to the plane of the paper. By applying a sawtooth shaped voltage waveform to the horizontal winding of the yoke 21, the electron beam 19 is scanned across the entire horizontal dimension of the screen. Since the deflection takes place at a potential of V1, which is lower than the ultor voltage V2, the required deflection voltage is low and seems to be an advantage. However, because of the converging effect of the electrostatic fields 18 and 18*a* on the electron beam 19, the horizontal scan voltage must be increased sufficiently to overcome the converging effect, resulting in an objectionable increase of deflection power of the kinescope. It should be noted that the converging effect of the electrostatic field lines 18 is circular because the electrodes 14 and 16 are circular so that the vertical deflection voltage also must overcome the converging effect.

FIG. 2 shows an electrostatic lens which eliminates the horizontal converging effect on the electron beam. The neck 12 contains parallel plates 22 which are centered in the neck 12 equidistant above and below the center so that only the top plate appears in FIG. 2. The space between the plates 22, therefore, is parallel to the direction of horizontal scanning. The yoke 21 is positioned so that the electron beams enter the space between the two plates 22 after being deflected by the yoke. The plates 22 are biased with a voltage V1 which is lower than the biasing voltage V2 applied to the electrode 14 on the inside of the funnel 11. The end 23 of the plates 22 which faces the screen (not shown) is curved so that the equipotential lines 18 formed by the plates 22 and the electrode 14 are curved similarly to the curvature of the end 23 of the plates 22 and the equipotentials 18*a* of FIG. 1 which bend back into the neck 12 are eliminated. The perpendiculars to the tangents of the equipotential lines 18 point away from the center line of the kinescope so that the converging portion of the prior art lens shown in FIG. 1 is eliminated and only the diverging portion is retained. The curve 23 can be an arc having any of several configurations, such as, parabolic or elleptical, but preferably is circular because the normal to the tangents will be uniformly angularily spaced with respect to the center line of the kinescope.

FIG. 3*a* shows a quadrupole lens 24 of a type known in the art. The quadrupole 24 includes two north poles 26*a* and 26*b* and two south poles 27*a* and 27*b* alternately spaced at 90° intervals around the center 28 of a 3-axis system. The magnets 26*a*, 26*b*, 27*a* and 27*b* have equal strength and are equally spaced about the center 28 and, therefore, the magnetic field lines cancel at the center of the system. Accordingly, an electron beam travelling at the center 28 in the direction z, out of the plane of the paper, will be uneffected by the quadrupole. However, the field lines establish a convergent or focusing action along the x-axis and a divergent or defocusing action along the y-axis when the beam travel is displaced from the center 28.

Figure 3B:
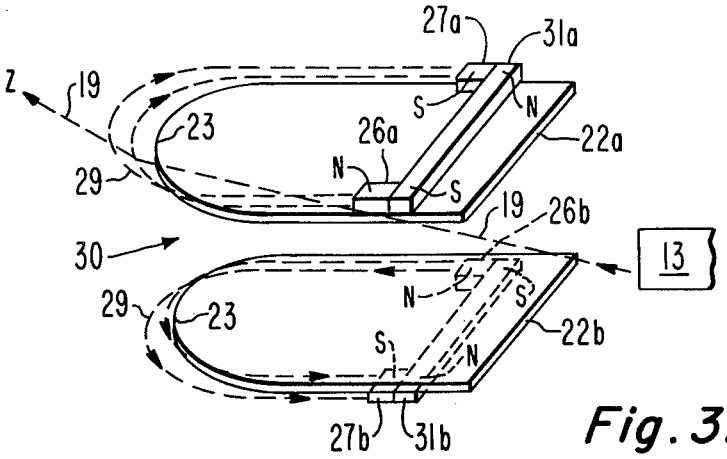
FIG. 3*b* is a simplified perspective of an electrostatic lens in combination with a quadrupole lens.

FIG. 3*b* is a preferred embodiment combining the plates 22*a* and 22*b* of the electrostatic lens of FIG. 2 with a quadrupole lens modified to include ferromagnetic numbers 31*a* and 31*b*. The permanent magnets 26*a* and 27*a* are positioned on the upper surface of the upper plate 22*a*. Similarly, the magnets 26*b* and 27*b* are positioned on the bottom surface of the lower plate 22*b* so that the path of the electrons in the space 30 between the plates is unobstructed. The magnets 26*a*, 27*a*, 26*b* and 27*b* are orientated so that their north and south poles are parallel to the direction of undeflected electron beam tunnel. Also, the magnets are arranged so that adjacent magnets have the north pole facing in opposite directions. The first ferromagnetic shunt 31*a* extends between the permanent magnets 26*a* and 27*a* and the second ferromagnetic shunt 31*b* extends between the magnets 26*b* and 27*b*. In addition to shunting the magnetic flux the shunts 31*a* and 31*b* also maintain the orientations of the magnets with the poles aligned parallel to the direction of undeflected electron beam travel. The electrostatic plates 22*a* and 22*b* also are ferromagnetic so that only negligible, if any, flux lines extend between magnets 26*a* and 27*b* or 26*b* and 27*a* across the space 30 between the plates 22*a* and 22*b*. However, because the poles of the magnets are parallel to the electron beam travel, the flux lines 29 are substantially parallel to the surfaces of the plates 22*a* and 22*b*, and extend outwardly, from the north poles past the curved ends 23 of the plates to curve back to the south poles. The magnetic flux lines then return to the north magnets through the low reluctance path provided by the ferromagnetic shunts 31*a* and 31*b*. The flux lines 29 bend the electron beams away from the center line of the kinescope and thus enhance the vertical deflection. However, the magnetic flux which ordinarily would extend into the space 30 between plates 22*a* and 22*b* because of the magnet pairs 26*a*/27*a* and 26*b*/27*b* take the path of lesser reluctance through the ferromagnetic members 22*a*, 22*b*, 31*a* and 31*b*. Accordingly, both the internal focusing and defocusing actions of the quadrupole are substantially eliminated by the ferromagnetic plates 22*a* and 22*b* and shunts 31*a* and 31*b*. However, because the flux lines 29 extend outwardly out past the ends of the electrostatic plates 22*a* and 22*b*, a substantial external divergent action is obtained. Accordingly, an electron beam 19 travelling between the plates is horizontally and vertically unaffected by the quadrupole lens. Upon leaving the quadrupole lens the electron beam encounters the flux lines 29 and is bent away from the center line to substantially increase the vertical deflection of the kinescope.

Figure 4:
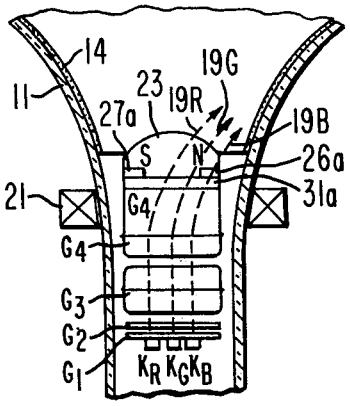
FIG. 4 is a partially broken cross-section showing the horizontal deflection in a kinescope incorporating the preferred embodiment.

FIG. 4 is a broken away cross-section showing the horizontal deflection in a post-deflection acceleration type kinescope incorporating the preferred embodiment of FIG. 3. The kinescope includes cathodes KR, KG, KB, which provide electron beams for the basic colors, red, green and blue, of a color type kinescope. The kinescope includes a standard lens system having electrodes G1, G2, G3 and G4, which control and focus the electron beams in known manner. The electrostatic plates 22*a* and 22*b* are equally spaced above and below the center of the kinescope so that only the plate 22*a* is visible in FIG. 4. The plates 22*a* and 22*b* are spaced from the electrode 14 inside the funnel 11 and are positioned with respect to the yoke 21 so that the beams are horizontally and vertically deflected prior to enhancement by the preferred embodiment. Accordingly, prior to the electron beam enterance into the space 30 between the plates 22*a* and 22*b* the horizontal and vertical deflection voltages applied to the yoke 21 deflect the beams. Subsequent to the deflection the electrons are accelerated because the potential V2 on the electrode 14 exceeds the potential V1 on the plates 22*a* and 22*b*. However, the curvature of the equipotential lines of the lens formed by the plates 22 and electrode 14 cause the electron beams to cross the equipotential lines in straight paths without bending toward the center line of the kinescope so that the converging action of the prior art post-deflection acceleration kinescopes is eliminated. For this reason, the horizontal deflection voltage can be substantially reduced without reducing the horizontal deflection angle. A substantial reduction in the required deflection power is thus realized. Alternatively, the spacing between the electron gun and the faceplate can be decreased, resulting in the long sought benefit of decreasing the overall length of the tube. Another distinct advantage of the invention arises because the increased spacing between the plates 22*a*, 22*b* and the electrode 14 allows the use of an increased voltage differential without arcing occurring. The electron beam acceleration can thus be increased, resulting in a brighter visual output.

Figure 5:
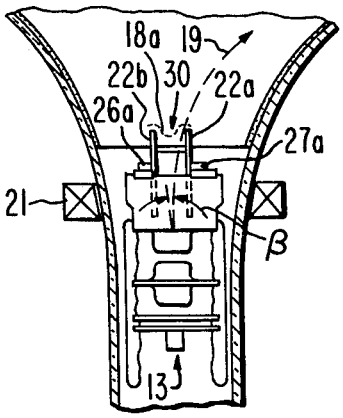
FIG. 5 is a cross-section of the FIG. 4 embodiment rotated 90° to show the vertical deflection.

FIG. 5 shows the preferred embodiment of FIG. 4 rotated 90° to show electron beam deflection in the vertical direction. The voltages V1 and V2 on the plates 22*a* and 22*b* and electrode 14 respectively cause equipotential lines 18*a*, which curve into the space 30 between the plates 22*a* and 22*b*. These equipotentials tend to bend the electron beams toward the center line of the kinescope. The vertical scanning voltage applied to the yoke 21 deflects the electron beam 19 at an angle $\beta$ so the beam travels at that angle between the plates 22*a* and 22*b*. When the beam encounters the magnetic flux lines 29 (FIG. 3) the beam is curved away from the center line and vertical deflection angle $\beta$ is increased by an amount which exceeds the convergence caused by the electrostatic lens. The net result, therefore, is an increase in the vertical deflection.

Figure 6:
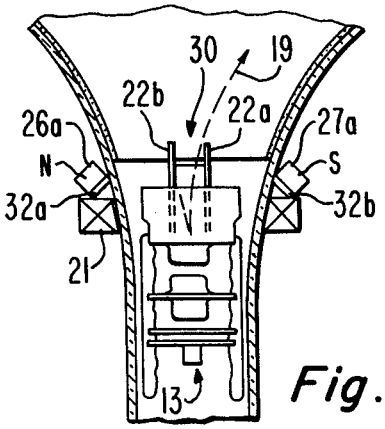
FIG. 6 is a partially broken away cross-section showing the vertical deflection in a kinescope incorporating a second preferred embodiment.

FIG. 6 is a cross-section of a kinescope incorporating the electrostatic plates 22*a* and 22*b* and a quadrupole lens arranged outside the envelope. The quadrupole magnets 32*a* and 32*b*, and two of which are not shown, are arranged around the yoke 21 on the screen side. Additionally, the shunts 31*a* and 31*b* of the FIG. 3 embodiment are replaced by arcuate ferromagnetic shunts 32*a* and 32*b* which are partially arranged around the outside of the neck 12 and, respectively, bridge the plates 22*a* and 22*b*. The effect of the quadrupole outside the tube is, therefore, identical to that of the FIG. 4 embodiment in which the quadrupole is internal to the tube.

What is claimed is:

1. In a post-deflection acceleration kinescope including an evacuated envelope having a funnel portion, a neck portion, a screen hermetically affixed to the wide end of said funnel portion, and a conductive coating on the inside surface of said funnel portion, an electron gun for providing at least one electron beam arranged in said neck portion, and a deflection yoke for horizontally and vertically deflecting said electron beam so that said screen is scanned with said electron beam, a deflection system for enhancing said horizontal and vertical deflection comprising:

an electrostatic lens including said conductive coating and planar plates with curved edges on the screen side arranged parallel to the direction of said horizontal scanning and equally spaced about the center of said neck portion so that said electron beam passes between said plates and is horizontally unaffected by said electrostatic lens;

a quadrupole lens in combination with said electrostatic lens said quadrupole having an internal defocusing action acting in the direction of said vertical deflection and an internal focusing action acting in the direction of said horizontal deflection, and having a first pair of poles of said quadrupole arranged to produce a first magnetic field extending substantially parallel along the plane of one said plates and outwardly past the curved end of said plate, a second pair of poles of said quadrupole being arranged to produce a second magnetic field extending substantially parallel along the plane of another of said plates and outwardly past the curved end of said another plate so that electron beams exiting from said plates are deflected away from the center line of said kinescope by one of said magnetic fields, and first low reluctance means arranged between the poles of said first pair to provide a first low reluctance return flux path and second low reluctance means arranged between the poles of said second pair to provide a second low reluctance return flux path so that the vertical and horizontal deflections of an electron beam are enhanced upon leaving said quadrupole and are unaffected while passing between said plates.

2. The deflection system of claim 1 wherein the poles of said quadrupole are magnets arranged with the north and south poles parallel to the direction of undeflected electron beam travel and adjacent magnets have north poles facing in opposite directions.

3. The deflection system of claim 2 wherein said magnets are permanent magnets supported by said curved plates.

4. The deflection system of claim 3 wherein said first and second low reluctance means are first and second ferromagnetic members individually extending the width of said plates between the magnets of said first and second pairs.

* * * * *